US005431760A

United States Patent [19]

Donovan

[11] Patent Number: 5,431,760

[45] Date of Patent: Jul. 11, 1995

[54] ZIPPER SLIDER INSERTION THROUGH SPLIT TRACK

[75] Inventor: Terry J. Donovan, Penfield, N.Y.

[73] Assignee: Mobil Oil Corporation, Fairfax, Va.

[21] Appl. No.: 235,998

[22] Filed: May 2, 1994

[51] Int. Cl.[6] ..... A41H 37/06

[52] U.S. Cl. ..... 156/66; 24/399

[58] Field of Search ..... 156/66, 250; 383/64; 24/400, 399, 436; 29/408

[56] References Cited

U.S. PATENT DOCUMENTS

| | | | |
|---|---|---|---|
| 3,202,559 | 8/1965 | Laguerre | 383/64 X |
| 3,426,396 | 2/1969 | LaGuerre | 24/201 |
| 3,554,822 | 5/1967 | Schwarzkopf | 156/66 |
| 5,007,143 | 4/1991 | Herrington | 24/400 |
| 5,010,627 | 4/1991 | Herrington et al. | 24/400 |
| 5,063,644 | 11/1991 | Herrington et al. | 24/400 |
| 5,067,208 | 11/1991 | Herrington et al. | 24/400 |
| 5,070,583 | 12/1991 | Herrington | 24/400 |
| 5,131,121 | 7/1992 | Herrington et al. | 24/436 |
| 5,161,286 | 11/1992 | Herrington et al. | 24/387 |

*Primary Examiner*—Michael W. Ball
*Assistant Examiner*—David W. Reed
*Attorney, Agent, or Firm*—Alexander J. McKillop; Malcom D. Keen; L. Gene Wise

[57] ABSTRACT

In a continuous bag-making process, the film and zipper track moves intermittently through a bag machine in a continuous stream, so there is no end to the zipper track on which the slider can be inserted. In the present invention, in the intermittent motion-part of the bag machine, the zipper is cut apart at the location that is to be the edge of the bag, the ends formed by the cutter moved laterally relative to each other exposing the ends and the slider is inserted over one of the exposed ends.

4 Claims, 2 Drawing Sheets

ZIPPER SLIDER INSERTION THROUGH SPLIT TRACK

BACKGROUND OF THE INVENTION

The present invention relates to a continuous process for making zippered plastic bags and particularly to the method of installing a plastic slider on the plastic zipper profile attached to the mouth of the bag.

Plastic reclosable fasteners or zippers with sliders are well known in the art. The plastic zippers have profiles and include a pair of male and female fastener elements in the form of reclosable interlocking rib and groove elements with a slider riding on the zipper for opening and closing the rib and groove elements. Sliders are generally of a U-shaped configuration having inwardly extending shoulders at the open end of the U to maintain the slider on the zipper as the slider is moved from one end to the other of the zipper. In the manufacture of thermoplastic film bags, a pair of the male and female fasteners extend along the mouth of the bags and these male and female elements are adapted to be secured in any suitable manner to the flexible walls of the thermoplastic film bags. These elements may be integral marginal portions of such walls or they may be extruded separately and thereafter attached to the walls along the mouth of the bag.

For reasons of economy, it is desirable to make the zippered plastic bags by a continuous bag making process. In such process a continuous web of plastic bag material having a plastic zipper profile attached to one edge thereof is moved along a predetermined path. The movement of the zipper and web bag material is periodically interrupted to assemble the slider with the zipper by a relative transverse maneuver and to concurrently form a side seal across the thermoplastic sheets between adjacent bags and to sever the completed bag from the end of the continuous web of plastic bag material. At the same time end stops at the ends of the zipper may be formed to prevent the slider from going off past the end of the zipper and coming off of the bag. Examples of this are disclosed in Herrington et al U.S. Pat. No. 5,131,121 and U.S. Pat. No. 5,161,286. Sliders that may be assembled with the zipper by a transverse movement, while they may be of the flexible plastic one-piece type as disclosed in Laguere U.S. Pat. No. 3,426,396, preferably are of the foldable plastic type, examples of which are disclosed in Herrington et al U.S. Pat. No. 5,010,627, Herrington et al U.S. Pat. No. 5,063,644 and Herrington et al U.S. Pat. No. 5,067,208 and Herrington U.S. Pat. No. 5,070,583. While sliders have heretofore been assembled endwise with zippers, this method of assembly does not lend itself to a continuous bag making process. It would be desirable to utilize an endwise assembly of a slider on a zipper in a continuous bag making process and thus permit the use of a relatively strong plastic one-piece slider which is structurally stronger than one that has to be assembled transversely on the bag line.

SUMMARY OF THE INVENTION

It is an object of the present invention to provide a continuous process and system for making zippered plastic bags wherein the zipper slider is inserted onto a continuous zipper track by cutting the track, moving adjacent parts of the track apart, and inserting the slider over one exposed end.

The present invention relates to a continuous process of making zippered plastic bags comprising the steps of moving along a predetermined path, a continuous web of plastic bag material having a plastic zipper profile attached to one edge thereof, periodically interrupting the movement of the zipper and web of bag material along the path, while the movement is interrupted severing the zipper at a station along the path to produce adjacent cut ends in the zipper, moving the cut ends of the zipper laterally relative to each other to expose the ends, inserting a slider over one of the exposed ends, and thereafter continuing the movement of the zipper and web of bag material for a distance corresponding to a predetermined width of the zippered plastic bag to advance a new section of the zipper to the zipper severing station.

For a more detailed disclosure of the invention and for further objects and advantages thereof, reference is to be had to the following description taken in conjunction with the accompanying drawings.

DESCRIPTION OF THE PREFERRED EMBODIMENT

Figure 1:
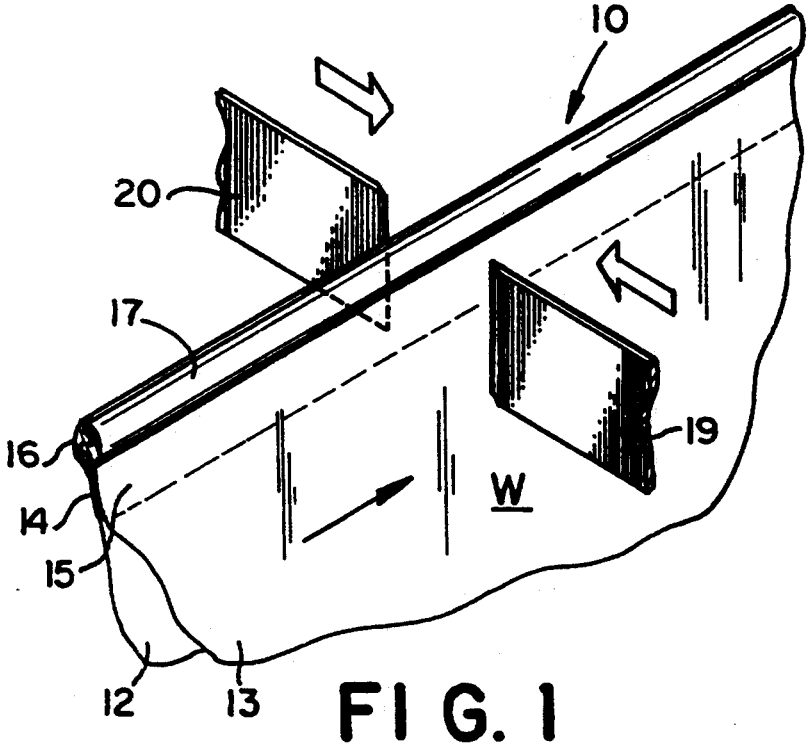
FIG. 1 is a fractional perspective view of a plastic zipper profile attached to one edge of a continuous web of plastic bag material at a station for severing the zipper to produce adjacent cut ends in the zipper.

Referring to the drawings, there is illustrated a continuous process and system for making zippered plastic bags. The process involves the use of a continuous web of plastic bag material W having a plastic zipper profile 10 attached to one edge thereof adapted to receive a slider. As may be seen in FIG. 1 the web material W comprises a pair of flexible plastic sheets 12 and 13 joined at the bottom, not shown, and having a top edge, with a pair of flexible plastic strips 14 and 15 having separable plastic means extending along the length thereof comprising reclosable interlocking male and female profile elements in the form of rib and groove elements 16 and 17 on the respective strips to form the zipper 10. The strips 14 and 15 may be extruded separately and attached to the respective sides of the bag mouth or the strips 14 and 15 may be extruded integral with the sides of the bag mouth. The rib and groove elements 16, 17 have complementary cross-sectional shapes such that they are closed by pressing the elements together with a slider 11, FIG. 4. The cross-sectional shapes of the interlocking male and female elements of the zipper 10 having the rib and groove profiles 16 and 17 may be of any type such for example as disclosed in U.S. Pat. No. 5,007,143. It is to be understood that the present invention is not limited to the shapes of the rib and groove profiles illustrated herein and that other shapes can be utilized in connection with the present invention. It is also to be understood that the present invention is not limited to the particular construction of the slider 11 disclosed herein and other zipper sliders may be utilized in connection with the present invention. The flexible plastic sheets 12 and 13 making up the web material W may be made from any suitable thermoplastic film such for example as polyethylene or polypropylene or equivalent material. The slider 11 may be molded from any suitable plastic such for example as nylon, polypropylene, polystyrene, Delrin or ABS. It is preferable that the slider be molded in one piece so that it is structurally stronger than a slider that has to be assembled on the bag line.

Figure 2:
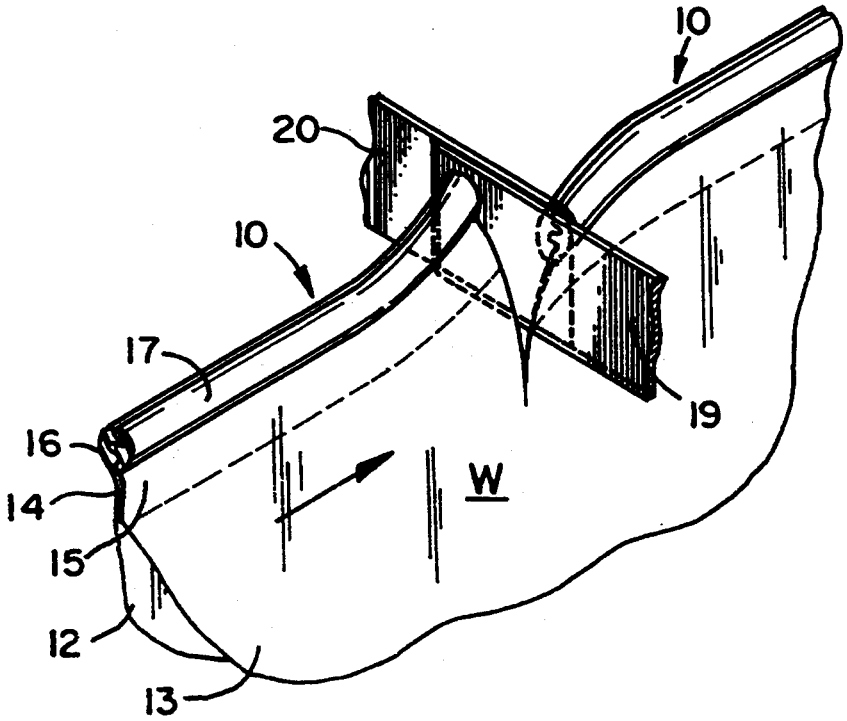
FIG. 2 is a fractional perspective view similar to FIG. 1 illustrating the severing operation and moving the cut ends of the zipper laterally relative to each other to expose the ends.
Figure 3:
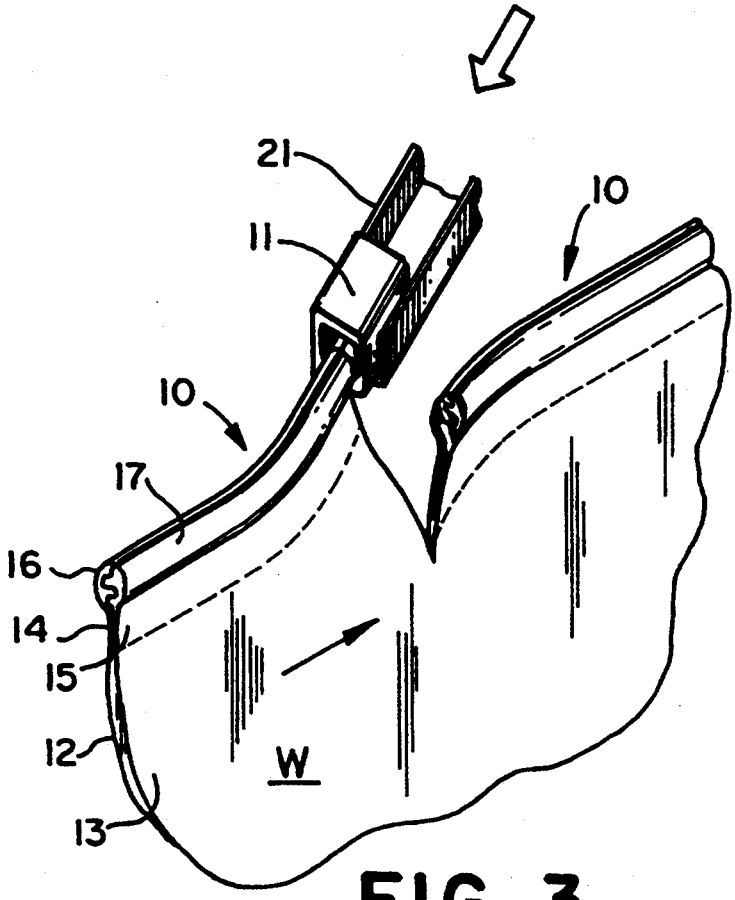
FIG. 3 is a fractional perspective view similar to FIGS. 1 and 2 illustrating the insertion of a slider over one of the cut ends of the zipper.
Figure 4:
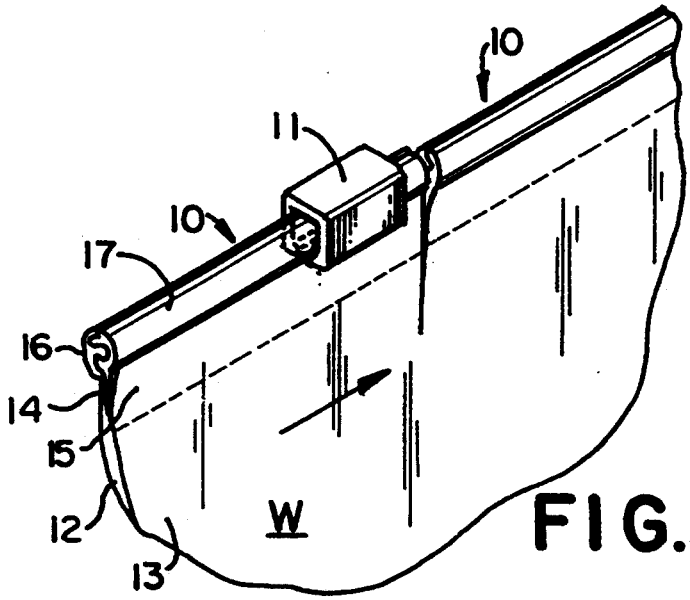
FIG. 4 is a fractional perspective view similar to FIGS. 1–3 and showing the slider after it has been assembled on the zipper.

Referring to FIG. 1, it will be seen that the present invention includes the step of moving along a predetermined path, as indicated by the longitudinal arrow, a continuous web W of plastic bag material having a plastic zipper profile 10 attached to one edge thereof. A pair of reciprocating knives 19 and 20 are positioned on opposite sides of the path of travel of the web material W. The knives 19 and 20 are adapted to move transversely to the path of web travel as indicated by the arrows in FIG. 1. The movement of the zipper 10 and web of bag material W along the path of travel is periodically interrupted and while the movement is interrupted the knives 19 and 20 sever the zipper 10 at a station along the path to produce adjacent cut ends in the zipper 10. This is best illustrated in FIG. 2. The cut ends of the zipper 10 are moved laterally relative to each other to expose the ends. This can normally be accomplished by the frictional engagement between the cut ends of the zipper 10 and the adjacent side surfaces of the knives 19 and 20. While the cut ends in the zipper 10 are laterally displaced, a slider 11 is fed from a magazine supply 21 of sliders over one of the cut ends of the zipper 10 as illustrated in FIG. 3. Once the cut ends of the zipper 10 are laterally displaced by the action of the knives 19 and 20, they will normally remain displaced due to the flexible nature of the bag material 12 and 13 in the web W. However, vertically extending retractable fingers may be utilized if necessary to maintain the cut ends of the zipper 10 displaced at the station illustrated in FIG. 3 during the assembly of the slider 11. The slider 11 is moved onto the end of the zipper 10 as shown in FIG. 4 and thereafter the movement of the zipper 10 and web of bag material W continues for a distance corresponding to a predetermined width of the zippered plastic bag to advance a new section of the zipper 10 to the zipper severing station. After the slider 11 has been positioned on the zipper 10 side seals (not shown) are formed in the web material W and end stops (not shown) are formed on the zipper 10 while the completed bag is being severed from the remaining continuous web of plastic bag material.

In a conventional continuous bag-making process, the film web and zipper track moves intermittently through the bag machine in a continuous stream, so there is no end to the zipper track onto which the slider can be inserted. Under the present invention, during the intermittent motion-part of the bag machine, the zipper is cut apart at the location that is to be the edge of the bag, the ends formed by the cutter moved laterally relative to each other exposing the ends, and the slider is inserted over one of the exposed ends. This eliminates the need for installing the slider transversely of the zipper and enables the use of a one-piece slider with no moving parts which is normally structurally stronger than sliders that require assembly as they are placed on the zipper.

While a preferred embodiment of this invention has been illustrated, it is to be understood that other modifications thereof may be made within the scope of the appended claims.

What is claimed is:

1. In a continuous process for making zipper plastic bags, the steps of moving along a predetermined path, a continuous web of plastic bag material having a plastic zipper profile attached to one edge thereof, periodically interrupting the movement of the zipper and web of bag material along the path, while the movement is interrupted, severing the zipper at a station along the path to produce adjacent cut ends in the zipper, moving the cut ends of the zipper laterally relative to each other to expose the ends, inserting a slider over one of the exposed ends prior to severing the bag material from the remaining continuous web, and thereafter continuing the movement of the zipper and web of bag material for a distance corresponding to a predetermined width of the zippered plastic bag to advance a new section of the zipper to the zipper severing station.

2. In a continuous process for making zippered plastic bags, the steps of moving along a predetermined path a continuous web of plastic bag material having a plastic zipper profile attached to one edge thereof, severing the zipper at a station along the path to produce adjacent cut ends in the zipper, moving the cut ends of the zipper laterally relative to each other to expose the ends, and inserting a slider over one of the exposed ends prior to severing the bag material from the remaining continuous web.

3. In a machine for the continuous manufacture of zippered plastic bags from a continuous web of plastic bag material having a plastic zipper profile attached to one edge thereof, the improvement comprising:

means for periodically severing the zipper to produce adjacent cut ends in the zipper, means for moving the cut ends of the zipper laterally relative to each other to expose the ends, and means for inserting a slider over one of the exposed ends of the zipper prior to severing the bag material from the remaining continuous web.

4. The process according to claim 1 wherein after the slider has been positioned in the zipper, side seals are formed in the web material and end stops are formed on the zipper while the completed bag is being severed from the remaining continuous web of plastic bag material.

* * * * *